United States Patent [19]

Stageman

[11] Patent Number: 5,048,989

[45] Date of Patent: Sep. 17, 1991

[54] CRAYON HOLDER

[76] Inventor: Steven D. Stageman, 5075 S. Illinois Ave., Apt. #11, Cudahy, Wis. 53110

[21] Appl. No.: 511,208

[22] Filed: Apr. 19, 1990

[51] Int. Cl.[5] ..... B43K 21/00

[52] U.S. Cl. ..... 401/83; 401/84; 401/109

[58] Field of Search ..... 401/84, 83, 82, 192, 401/65, 87

[56] References Cited

U.S. PATENT DOCUMENTS

| | | | |
|---|---|---|---|
| 206,791 | 8/1878 | Hopfen | 401/83 |
| 1,151,933 | 3/1915 | Fleming | 401/88 |
| 1,861,466 | 6/1932 | Bafetti | 401/82 |
| 2,205,907 | 6/1940 | Oxley | 401/88 |
| 2,591,831 | 4/1952 | Knuff | 401/83 |
| 2,762,336 | 9/1956 | Estes | 401/83 |
| 2,870,740 | 1/1959 | Vogt | 120/1 |
| 4,408,140 | 8/1984 | Tabachnik | 401/88 |
| 4,415,092 | 11/1983 | Boyer | 211/60 |
| 4,579,134 | 4/1986 | Moore | 401/192 |

FOREIGN PATENT DOCUMENTS

| | | | |
|---|---|---|---|
| 755879 | 8/1956 | United Kingdom | 401/82 |

*Primary Examiner*—Danton D. DeMille

*Attorney, Agent, or Firm*—Nies, Kurz, Bergert & Tamburro

[57] ABSTRACT

A crayon holder including a tubular sleeve for receiving and retaining a stick of writing material in the form of a crayon, chalk, or the like. The holder includes an inner slidable member having an opening to receive and retain one end of the stick of writing material to permit the writing material to be selectively extended outwardly from and to be retracted into one end of the sleeve. The retainer includes an outwardly extending positioning peg that is adapted to be received in a longitudinally extending slide slot formed in the sleeve. A plurality of laterally offset retaining slots are provided adjacent to and in communication with the longitudinal slide slot to permit the positioning peg to be received and retained at a desired axial position along the holder to expose a predetermined quantity of writing material and to prevent inward movement of the writing material when heavy writing pressure is applied.

8 Claims, 1 Drawing Sheet

CRAYON HOLDER

BACKGROUND OF THE INVENTION

1. Field of the Invention

The present invention relates to a holder for holding writing or drawing materials, such as crayons, chalk, or the like, and more particularly to a holder in the form of a protective tubular sleeve that includes a series of aligned positioning slots to receive positioning pegs to securely hold a stick of writing material in a desired position for use, so that the stick can be moved outwardly from the sleeve as the material is consumed.

2. Description of the Related Art

Various types of crayon holder devices have been disclosed in the prior art. For example, U.S. Pat. No. 2,205,907, which issued on June 25, 1940 to J. H. Oxley, discloses a cellulose acetate sleeve that has a greater diameter at one end than at the other end, and into which a cylindrical crayon is inserted. The sleeve has overlapped longitudinally extending edges that permit the diameter of the sleeve to be enlarged as the crayon is inserted to extend outwardly beyond the smaller diameter end of the sleeve. As the writing end of the crayon wears down as a result of use, the crayon can be pushed outwardly to present a renewed writing surface, the outward pushing action causing the overlapped portions of the sleeve to draw apart. The device permits a crayon to be used almost until it is completely used up, and without excessive waste of the material.

In U.S. Pat. No. 2,870,740, which issued on Jan. 27, 1959, to T. B. H. Vogt, there is disclosed a holder for crayons having a hexagonal cross-section, such as those used by carpenters and machinists. Again, the holder is in the form of a tubular sleeve, of hexagonal cross-section in this instance, and it is formed from a material that is resilient so that it firmly grips the outer surface of the crayon and permits the crayon to be periodically extended beyond one end for convenience in holding, and also to permit the crayon to be almost completely used up.

Various other forms of crayon holders have also been disclosed, and reference is made to U.S. Pat. Nos. 1,151,933; 4,468,146; and 4,415,092.

In general, the prior art devices are not very desirable because they permit some sliding movement between the crayon and the sleeve when high writing pressure is applied to the device. An exception to that is found among the patents listed above, specifically, U.S. Pat. No. 4,468,146, which discloses a threaded sleeve and collet arrangement, which is considerably more expensive to manufacture than are the sleeve-type devices disclosed in the other patents mentioned above.

It is an object of the present invention to provide an improved holder in sleeve form for a crayon, or the like, wherein the holder includes a positive stop so that when the holder is used, the crayon does not slide back into the sleeve as a result of high writing or drawing pressure during use.

It is a further object of the present invention to provide an improved crayon holder that is relatively inexpensive to manufacture.

It is a still further object of the present invention to provide an improved crayon holder that can be easily used by small children.

SUMMARY OF THE INVENTION

Briefly stated, in accordance with one aspect of the present invention, a holder is provided for holding a stick of writing material, such as a crayon, or the like. The holder includes an elongated tubular housing of substantially uniform interior cross-section adapted to slidably receive a stick of writing material, such as crayon, chalk, or the like. A retainer is provided for receiving and retaining the stick of writing material, the retainer having a longitudinal axis coaxial with the longitudinal axis of the writing material and including a transversely outwardly extending positioning peg. The housing includes an axially extending slide slot to receive the positioning peg and to allow sliding movement of the peg along the slot, and a plurality of axially spaced retaining slots that are laterally offset from and that communicate with the axial slide slot. Each retaining slot extends generally transversely from the slide slot and includes a retaining lip for retaining the positioning peg in a fixed position when the holder is in use. The device prevents inward axial displacement of the writing material, and also serves to prevent relative rotation between the writing material and the tubular sleeve.

DESCRIPTION OF THE PREFERRED EMBODIMENTS

Figure 1:
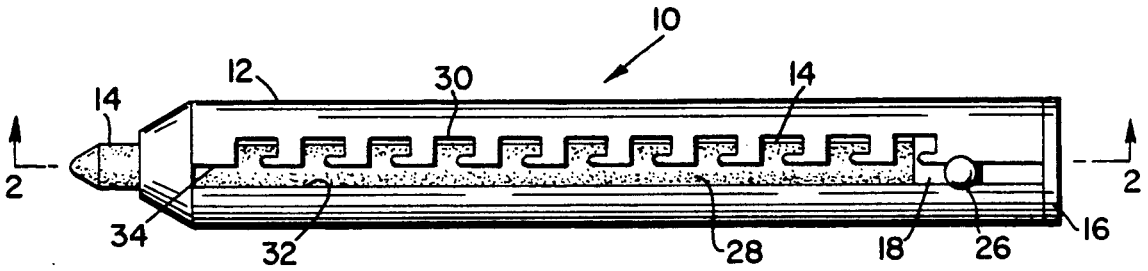
FIG. 1 is a top view of a crayon holder in accordance with the present invention.

Referring now to the drawings, and particularly to FIG. 1 thereof, there is shown a holder 10 in the form of a tubular sleeve 12 that surrounds and holds a cylindrical stick of writing material 14, such as a crayon, a piece of chalk, or the like. In that connection, as used herein, the term "crayon" broadly denotes a material used for drawing or writing and includes colored wax crayons, an example of which are crayons marketed under the brand name CRAYOLA by Binney and Smith, Inc., chalk, charcoal, and the like. Additionally, although described herein in terms of its use with material for writing or drawing, the holder device herein disclosed is also suitable for use with a stick of eraser material, which could be in cylindrical form, and such material is also comprehended within the term "crayon."

Sleeve 12 is of a predetermined length that is greater than the length of crayon 14, so that the latter can be retracted into the sleeve, if desired, for carrying purposes, or for protecting the writing end of the crayon. Additionally, sleeve 12 can have a relatively thin wall thickness, such as about 1/16 inch or so, and can be formed from a tube of extruded plastic material, or it can be injection molded, if desired. The plastic material can be of any desired color, and it can also be transparent to permit rapid identification of the type or color of the writing material within holder 10, and also of the available length of that material.

Sleeve 12 preferably includes an end cap 16 that closes off the end of sleeve 12 opposite the end from which crayon 14 is adapted to extend. Finally, although described herein in terms of a cylindrical sleeve, it will be apparent to those skilled in the art that the cross-sectional configuration of the sleeve can take any of a number of forms, and can be, for example, hexagonal, square, or the like.

Figure 2:
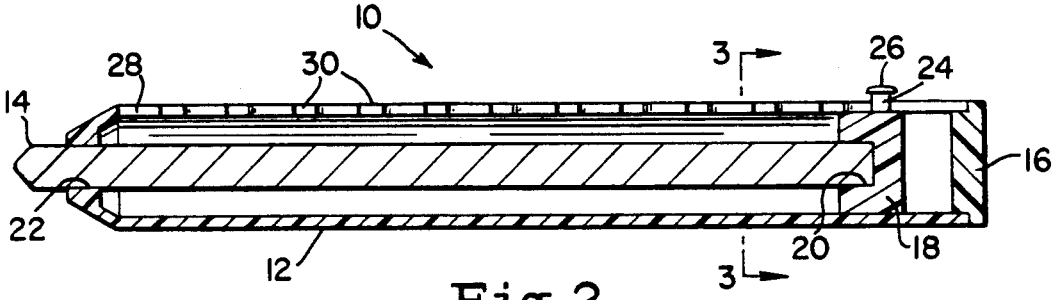
FIG. 2 is a side cross-sectional view of the crayon holder shown in FIG. 1, and taken along the line 2—2 thereof.

Referring now to FIG. 2, there is shown a cross-sectional view of a holder 10 of the type illustrated in FIG. 1, including crayon 14, and also a crayon retainer 18 for holding and retaining one end of crayon 14 when it is positioned within holder 10. Retainer 18 preferably has an outer surface that conforms in size and shape with the inner surface of sleeve 12, and it is slidable in an axial direction along the inner surface of the sleeve. A recess 20 is provided in retainer 18, the recess serving to receive and grip one end of the crayon to permit the crayon to be extended outwardly from and retracted inwardly of the outlet opening 22 formed at one end of sleeve 12. For purpose of moving retainer along sleeve 12, retainer 18 includes a radially outwardly extending positioning peg 24 that terminates in a flat-headed adjustment tab 26. Although sleeve 12 can be of any desired cross-sectional shape, both recess 20 and outlet opening 22 preferably have the same size and cross section as that of crayon 14, to grip and retain the crayon within sleeve 12 without excessive lateral movement.

As also apparent in FIG. 2, sleeve 12 can have an inner diameter or size that is substantially greater than that of the crayon, which permits easier gripping of holder 10 by smaller children. Additionally, because outlet opening 22 preferably corresponds substantially in size and shape with the cross-sectional size and shape of the crayon, it serves to guide the crayon as it is extended from or retracted into sleeve 12.

At the opening at the opposite end of sleeve 12 from outlet opening 22, removable end cap 16 is preferably friction fitted to sleeve 12, for convenience, or it can be threaded thereto (not shown) if desired.

Figure 3:
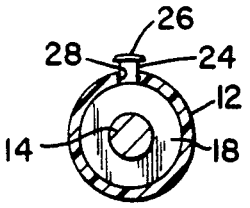
FIG. 3 is a cross-sectional view taken along the line 3—3 of FIG. 2.

Although as earlier noted the external surface of the sleeve can be cylindrical, octagonal, square, or the like, as desired, preferably the interior surface of sleeve 12 is cylindrical, in order to permit limited rotation therewithin about the longitudinal axis of sleeve 12 of retainer 18, as illustrated in FIG. 3.

In use, a blunt end of crayon 14 is firmly inserted into recess 20 formed in retainer 18, so that crayon 14 is securely held therein. Crayon 14 and attached retainer 18 are then inserted into sleeve 12 through the larger open end thereof, whereupon that end can be closed by means of removable end cap 16. As is apparent from FIG. 2, the initial length of crayon 14 is preferably less than the overall length of sleeve 12, to permit crayon 14 to be completely retracted within sleeve 12, if desired.

When crayon 14 is desired to be used for writing or drawing, adjustment tab 26 is pushed toward the narrower outlet opening 22 of sleeve 12 until a desired quantity of writing material is exposed for use. The sliding movement occurs along a longitudinally extending slide slot 28 that is formed in the wall of sleeve 12. When a desired length of crayon is exposed for use, adjustment tab 26 is pushed laterally relative to the sleeve axis, to cause positioning peg 24 to be moved out of slide slot 28 and into one of laterally offset retaining slots 30. Crayon 14 can then be used with the assurance that heavy pressure applied to the crayon will not cause it to be pushed back into sleeve 12, by virtue of the fact that positioning peg 24 is retained within offset retaining slot 30. As the writing end of the crayon is progressively consumed, crayon 14 can be further extended by moving positioning peg 24 out of one retaining slot 30 and back into longitudinal slide slot 28, whereupon peg 24 and crayon retainer 18 can be moved axially toward outlet end 22 of sleeve 12 to expose an additional length of crayon, whereupon positioning peg 24 can be moved laterally once again, relative to slide slot 28, so that peg 24 is positioned in another of offset retaining slots 30. After use, crayon 14 can be retracted into sleeve 12 by reversing the procedure just described, which involves moving positioning peg 24 laterally from offset retaining slot 30 so that it once again enters longitudinal slide slot 28, and then moving peg 24 in a direction away from the writing end until crayon 14 is completely retracted within sleeve 12, whereupon positioning peg 24 is then again shifted laterally into a retaining slot 30 to retain crayon 14 in its retracted position.

Figure 4:
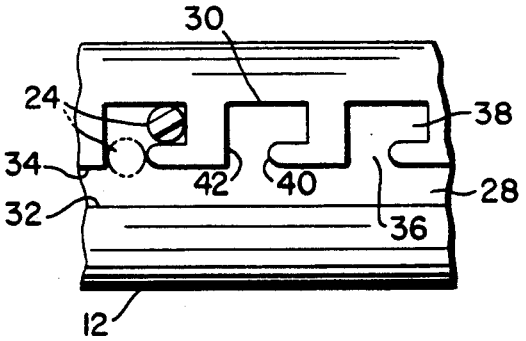
FIG. 4 is an enlarged top view of the slide slot and positioning slot forming part of the crayon holder illustrated in FIG. 1.

Referring now to FIG. 4, there is shown the preferred configuration for offset retaining slots 30, a plurality of which are positioned in aligned relationship along one side of longitudinal slide slot 28 and in communication therewith. As shown, longitudinal slide slot 28 is defined by a pair of spaced, parallel, longitudinally extending edges 32, 34 that preferably are spaced from each other a distance just slightly greater than the diameter of positioning peg 24, in order to prevent binding of peg 24 within slot 28 when holder 10 is in use. Each of retaining slots 30 includes a laterally extending inlet slot 36 that also has a size sufficient to permit positioning peg 24 to readily pass therethrough, and a locking slot 38 that extends from lateral slot 36 and is parallel with longitudinal slide slot 28. Locking slot 38 has substantially parallel inner and outer walls 40, 42 that also are spaced from each other a distance corresponding substantially with the diameter of positioning peg 24 to permit easy sliding movement of peg 24 into and out of locking slot 38. As is apparent from FIG. 4, when positioning peg 24 is in the position illustrated in full lines, it is securely restrained against axial movement in a direction toward removable end cap 16, and it is also securely restrained against rotation relative to sleeve 12. In that regard, offset retaining slot 30 includes an axially extending retaining lip 40 to confine peg 24 against rotation toward and away from longitudinal slide slot 28.

It can thus be seen that the present invention provides an improved crayon holder that is easy to use, that securely holds and positions the crayon in a desired writing position, and that is also of simple construction and is inexpensive to manufacture.

Although particular embodiments of the present invention have been illustrated and described, it will be apparent to those skilled in the art that various changes and modifications can be made without departing from the spirit of the present invention. Accordingly, it is intended to encompass within the appended claims all such changes and modifications that fall within the scope of the present invention.

What is claimed is:

1. A holder and a stick of writing material, said holder holding said stick of material for writing or drawing, or the like, said holder comprising:

a. material retaining means for attaching and retaining a stick of writing material, the retaining means having a longitudinal axis coaxial with a longitudinal axis of the writing material and including a transversely extending positioning peg; and b. An elongated tubular sleeve of substantially uniform interior cross-section adapted to freely axially and rotatably slidably receive the retaining means and to freely axially and rotatably slidably receive a stick of writing material, the sleeve including an elongated, axially extending slide slot to receive the positioning peg, a plurality of axially spaced, laterally extending inlet slots, each inlet slot communicating with the slide slot, and a locking slot extending from each inlet slot and in a direction substantially parallel to the slide slot for receiving and retaining the positioning peg in a fixed position when the holder is in use by preventing inward axial displacement of the retaining means, the locking slot and inlet slot defining a retaining lip adjacent the slide slot for confining the positioning peg against rotation toward and away from the slide slot and for preventing rotation between the retaining means and the stick of material relative to the sleeve.

2. A holder in accordance with claim 1, wherein the sleeve includes a first end through which the writing material is adapted to extend, and a second end, the second end including end cap means for closing the second end of the sleeve.

3. A holder in accordance with claim 2, wherein the end cap means is removably to permit replenishment of the writing material after it has worn down to a point at which it is no longer capable of extending beyond the first opening.

4. A holder in accordance with claim 1, wherein the positioning peg includes an outer end that carries an adjustment tab.

5. A holder in accordance with claim 1, wherein the sleeve is formed from a translucent thermoplastic material.

6. A holder in accordance with claim 1, wherein the stick of writing material has an outer dimension that is smaller than a corresponding inner dimension of the sleeve.

7. A holder in accordance with claim 6, wherein the stick of material has the same cross-sectional configuration and size as that of the first end of the sleeve.

8. A holder in accordance with claim 6, wherein the sleeve cross-section is greater than the material cross-section and the sleeve has an opening at one end to conform with and to slidably receive the material.

* * * * *